US012359522B2

(12) United States Patent
Abou-Assaad

(10) Patent No.: US 12,359,522 B2
(45) Date of Patent: Jul. 15, 2025

(54) FLEXIBLE LINEAR ACCESSIBLE CONTROLS SUBSEA

(71) Applicant: Hydril USA Distribution LLC, Houston, TX (US)

(72) Inventor: Amine Abou-Assaad, Houston, TX (US)

(73) Assignee: HYDRIL USA DISTRIBUTION LLC, Houston, TX (US)

( * ) Notice: Subject to any disclaimer, the term of this patent is extended or adjusted under 35 U.S.C. 154(b) by 0 days.

(21) Appl. No.: 18/499,695

(22) Filed: Nov. 1, 2023

(65) Prior Publication Data

US 2024/0151115 A1 May 9, 2024

Related U.S. Application Data

(60) Provisional application No. 63/422,577, filed on Nov. 4, 2022.

(51) Int. Cl.

| | |
|---|---|
| ***H01S 3/00*** | (2006.01) |
| ***E21B 33/035*** | (2006.01) |
| ***G02B 6/26*** | (2006.01) |
| ***H02G 15/14*** | (2006.01) |
| ***H05K 7/20*** | (2006.01) |

(52) U.S. Cl.
CPC ..... *E21B 33/0355* (2013.01)

(58) Field of Classification Search
None
See application file for complete search history.

(56) References Cited

U.S. PATENT DOCUMENTS

| | | | | |
|---|---|---|---|---|
| 4,795,128 | A * | 1/1989 | Krasnov | F16K 31/1225 175/218 |
| 9,631,455 | B2 * | 4/2017 | Geiger | F15B 15/18 |
| 10,041,323 | B2 * | 8/2018 | Vanderford | E21B 33/03 |
| 10,827,650 | B2 * | 11/2020 | Grassi | H02G 15/14 |
| 2004/0100273 | A1 | 5/2004 | Liney et al. | |
| 2004/0175092 | A1 * | 9/2004 | Young | G02B 6/4248 385/100 |
| 2005/0104164 | A1 * | 5/2005 | Awujoola | H01L 23/3128 257/659 |
| 2005/0105164 | A1 * | 5/2005 | Young | H01S 3/06704 359/333 |

(Continued)

OTHER PUBLICATIONS

International Search Report issued in corresponding International Application No. PCT/US2023/036690 mailed Feb. 9, 2024 (4 pages).

(Continued)

*Primary Examiner* — Matthew R Buck
*Assistant Examiner* — Douglas S Wood
(74) *Attorney, Agent, or Firm* — Osha Bergman Watanabe & Burton LLP

(57) ABSTRACT

A housing system includes a housing body having an internal cavity and an opening. A cap is removably fitted to the opening using a set of sliders. Each slider in the set of sliders has a fixed rail secured to an internal surface of the housing body and a dynamic rail connected to an inner surface of the cap. The cap slides between open and closed configurations on the dynamic rail. One or more components are also connected to the inner surface of the cap, such that when the cap is opened, the one or more components are accessible.

14 Claims, 3 Drawing Sheets

(56) References Cited

U.S. PATENT DOCUMENTS

| | | | | |
|---|---|---|---|---|
| 2005/0185257 | A1* | 8/2005 | Young | G02B 6/4448 359/333 |
| 2012/0043089 | A1* | 2/2012 | Hoffman | E21B 33/064 166/365 |
| 2013/0341934 | A1* | 12/2013 | Kawanishi | F03D 9/007 290/55 |
| 2019/0226292 | A1 | 7/2019 | Noske | |
| 2019/0257728 | A1 | 8/2019 | Gustafson | |
| 2020/0072011 | A1* | 3/2020 | Abou-Assaad | E21B 33/0355 |
| 2022/0136356 | A1* | 5/2022 | Poveda | E21B 34/16 166/373 |

OTHER PUBLICATIONS

Written Opinion issued in corresponding International Application No. PCT/US2023/036690 mailed Feb. 9, 2024 (8 pages).

* cited by examiner

FLEXIBLE LINEAR ACCESSIBLE CONTROLS SUBSEA

BACKGROUND

In offshore operations, including drilling and production operations, a floating structure, such as a platform or vessel, may be stationed at water level above a well location at the sea floor. Surface equipment may be provided on the floating structure to support and perform well operations, while subsea equipment may be provided underwater to support and perform well operations subsea. For example, a blowout preventor (BOP) stack may be installed at the well head, on the sea floor, which may be used to control fluid flow from the well. Other subsea equipment may be provided with the BOP or fluidly connected to the BOP to aid in the well operation and provide fluid communication between the well and the surface equipment. Offshore systems may be configured differently, depending on the well location and other operational parameters, using different components and component arrangements.

In order to control various subsea equipment in an offshore operation, different types of control systems may be used, including hydraulic and electric components. Controls for subsea equipment are often controlled at the surface. For example, controls on subsea equipment may be electrically connected to a surface control system, which may be used to operate the subsea controls. In some instances, subsea equipment may be controlled using remote operated vehicles (ROVs), where an ROV may be sent underwater to robotically activate one or more functions on a subsea equipment. In other instances, subsea equipment may be controlled using a housing system deployed to a subsea location.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a housing system that includes a housing body having an internal cavity and an opening. A cap is removably fitted to the opening using a set of sliders. Each slider in the set of sliders includes a fixed rail secured to an internal surface of the housing body and a dynamic rail connected to an inner surface of the cap, such that the cap may slide between open and closed configurations on the dynamic rail. One or more internal components of the housing system may also be connected to the inner surface of the cap, such that when the cap is opened, the one or more components are accessible.

In another aspect, embodiments disclosed herein relate to methods of accessing components within a housing system that includes one or more caps slidably connected to open or close openings to a housing body. The cap(s) may be slidably connected to the housing body using a set of sliders. An actuator may be used to slide the cap(s) to open or close the openings to the housing body. Activation of the actuator may be automated, where a signal sent from outside the housing body may be used to activate the actuator to open or close the cap(s).

Other aspects and advantages will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1A-2, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

Embodiments of the present disclosure relate generally to a housing system for storing electronics and power modules in a watertight environment, where the electronics and power modules are connected to subsea equipment. Further, embodiments of the present disclosure relate to a housing system with slidable caps, powered either by hydraulic or electrical actuators.

Figure 1A:
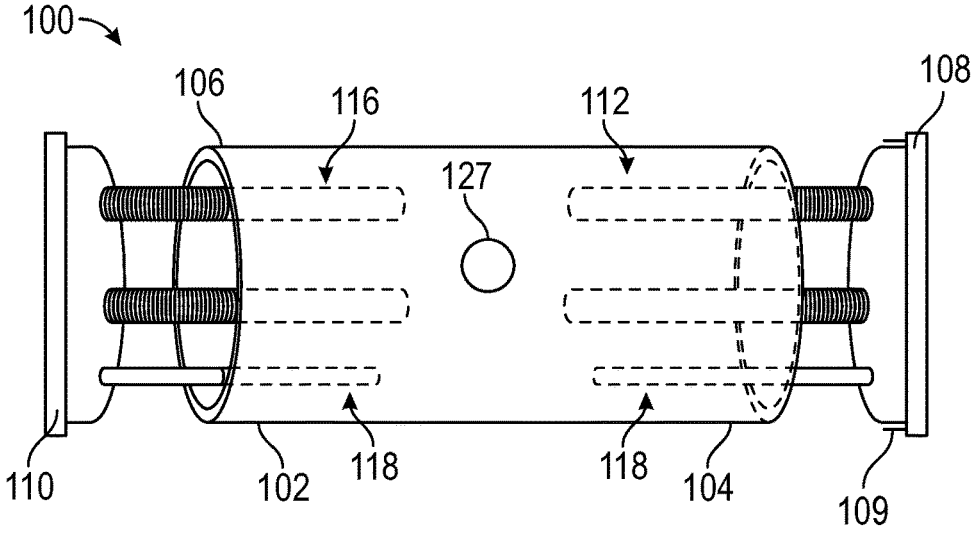
FIG. 1A-1D show a housing system in accordance with one or more embodiments.
Figure 1B:
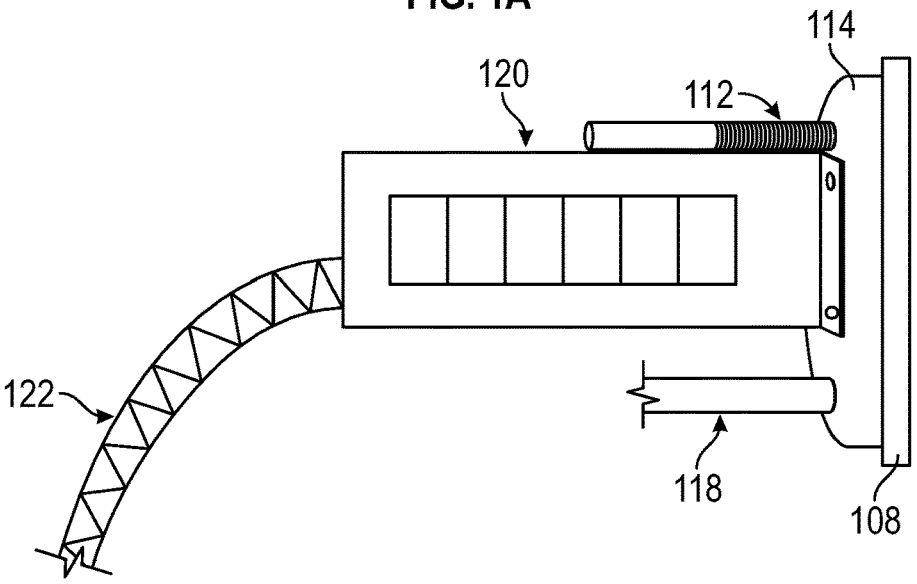
Figure 1C:
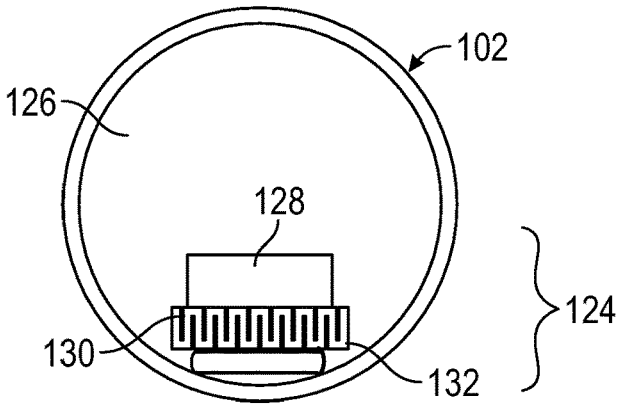

FIGS. 1A-1C show a housing system 100 in accordance with one or more embodiments. The housing system 100 may include a housing body 102 having a hollow internal cavity and at least one opening to the internal cavity. In one or more embodiments, the housing body 102 may be cylindrical and hollow. For example, in the embodiment shown in FIG. 1A, the housing body 102 may have a first end 104 and a second end 106, where each of the first end 104 and the second end 106 may have an opening to the internal cavity. In such embodiment, the housing body 102 may have a tubular shape with open axial ends.

The housing body 102 may have very thick walls and may be extremely heavy. For example, in one or more embodiments, the housing body 102 may have a wall with a thickness ranging, for example, between 0.5 in and 1.5 in (e.g., 1 in thick), and may weigh up to 2,500 lbs, for example. Due to the weight and size of the housing system 100, a crane may be required to transport the housing system 100 between locations, e.g., between surface and subsea locations. Accordingly, in some embodiments, one or more lift connections may be provided along the exterior of the housing system (e.g., on the exterior of the housing body 102 and/or a cap 108, 110), where crane lines may be connected to the lift connections to carry the housing. A lift connection may include, for example, a hook, a threaded connection, a ring, etc. In one or more embodiments, lift connections may be positioned around the housing in locations that allow a crane to lift, carry, and land the housing in generally consistent orientation, such that the components of the housing system are also kept in a generally consistent position.

A first cap 108 may be removably fitted to the first end 104. In one or more embodiments, the first cap 108 may be sized such that it fits snuggly into a receiving profile in the first end 104 of the housing body. In some embodiments, the first cap 108 may have a diameter equal to the outer diameter of the first end 104, such that when the first cap 108 is positioned adjacent to the first end 104, the first cap 108 entirely covers the first end 104. In a similar manner, a second cap 110 may be removably fitted to the second end 106. Further, in some embodiments, alignment pins 109 may be provided on an interfacing surface of a cap and/or on an interfacing surface of the housing body 102, which may be used to align the interfacing surfaces of the cap and housing body as the cap is fitted to an end of the housing body.

In one or more embodiments, each cap 108, 110 may have a thickness and may be formed of a material (e.g., metal) capable of withstanding high pressures present subsea, such as pressures of 25 kpsi or more. When cap material and thickness is designed to achieve high pressure ratings, the cap may weigh greater than 400 pounds, e.g., at least 500 pounds or at least 600 pounds, depending on the diameter and thickness of the cap.

According to embodiments of the present disclosure, each cap 108, 110 may be opened (to open and provide access to an opening at the end 104, 106 of the housing body 102, respectively) and closed (to close and seal an opening at the end 104, 106 of the housing body 102, respectively) using sets of sliders connected between each cap 108, 110 and the housing body 102. Each cap 108, 110 may be slidably connected to the housing body 102 using multiple sliders at each end 104, 106 of the housing body 102. For example, a first set of sliders 112 slidably connecting the first cap 108 to the first end 104 of the housing body 102 may include two, three, four, or more sliders. Similarly, a second set of sliders 116 slidably connecting the second cap 110 to the second end 106 of the housing body 102 may include two, three, four, or more sliders. In each set of sliders 112, 116, multiple sliders may be positioned circumferentially around the internal surface of the housing body 102, e.g., evenly spaced, symmetrically positioned, or axisymmetrically positioned around the internal surface of the housing body 102.

The sliders used to slidably connect the caps 108, 110 to the housing body 102 may include linear slide rails that slide relative to each other along a bearing, such as a roller bearing, ball bearings, and/or surface bearing. The rail material and size and the bearing type and size may be selected to carry, for example, 400 pounds or more. In one or more embodiments, the same type and size of slider may be used in each set of sliders 112, 116.

In one or more embodiments, as shown in FIG. 1A, a first set of sliders 112 may be secured to an internal surface of the housing body 102 at the first end 104 and an inner surface 114 of the first cap 108 to slidably connect the first cap 108 to the first end 104 of the housing body 102. For example, each slider in the first set of sliders 112 may include a fixed rail that is secured to the internal surface of the housing body 102, proximate the first end 104 of the housing, and a dynamic rail that is connected to the first cap 108. When assembled, the dynamic rail may slide relative to the fixed rail. In one or more embodiments, an inner surface 114 of the first cap 108 may be secured to an end of the first set of sliders 112 proximate the first end 104 of the housing, such that the first cap 108 may slide on the sliders 112 to close against the first end 104 of the housing body 102. The first set of sliders 112 may be fitted axially along the internal surface and the first set of sliders 112, where the rails of the sliders may be positioned parallel to one another about an axial center of the housing body 102.

Figure 1D:
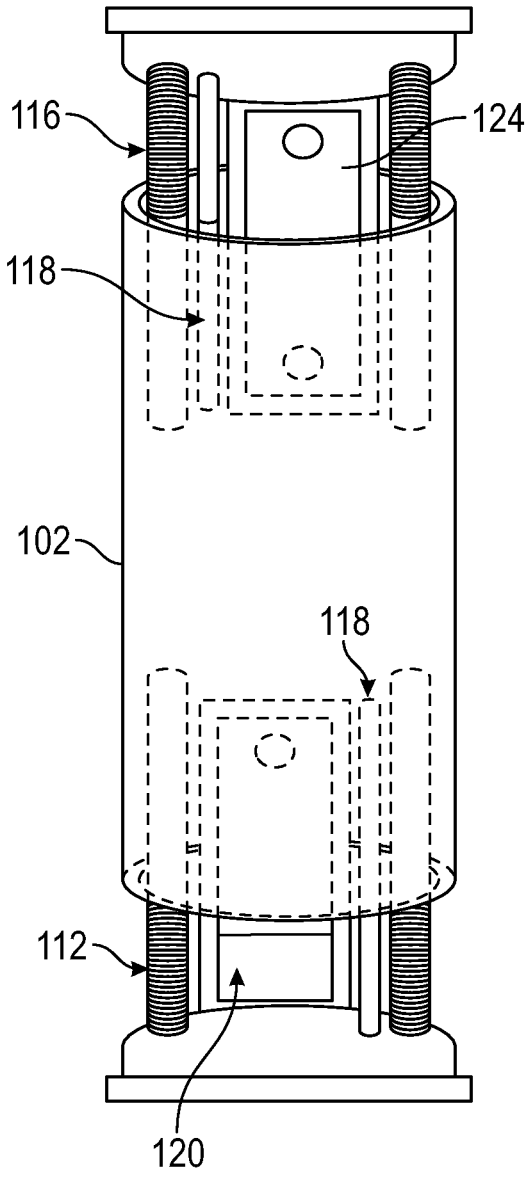

Similarly, a second set of sliders 116 may be secured to the internal surface of the housing body 102 at the second end 106. In one or more embodiments, the second set of sliders 116 may be similar to the first set of sliders 112, both in design and positioning within the housing body 102, relative to the second end 106 (e.g., sliders 116 may be disposed within the housing as a "mirror image" of the sliders 112). An inner surface 126 of the second cap 126 may be connected to an end of the second set of sliders 112, such that the second cap 126 may slide toward and away from the housing body 102 via the second set of sliders 116. FIGS. 1A, 1B, and 1D show the first and second sets of sliders 112, 116 in various circumferential positions around the internal surface of the housing body 102. However, a person skilled in the art may appreciate that sliders may be provided in various other circumferential positions, e.g., axisymmetrical positions.

According to embodiments of the present disclosure, one or more actuators 118 may be used to open and close the caps 108, 110, such as two, three, four or more actuators 118 operating collectively to open and close the caps 108, 110, respectively. Where multiple actuators are used, they may be disposed so as to provide an equal and balanced load per actuator (e.g., two actuators disposed 180° apart, three actuators disposed 120° apart, etc.). In some embodiments, as shown in FIG. 1A, two actuators 118 may be secured to the internal surface of the housing body 102, where each actuator 118 may be configured to extend and retract the first cap 108 and the second cap 110, respectively.

In some embodiments, an actuator may be integrated with a slider, where the actuator may slide the dynamic rail of the slider (and thus also the connected cap) relative to the fixed rail of the slider. In some embodiments, an actuator may be directly connected between the housing body and the cap, where the actuator may push or pull the cap relative to the housing body, and the sliders may be used to hold the cap in axial alignment with the housing body as the cap is moved by the actuator. For example, an actuator body may be connected to an interior surface of the housing body and an end of an actuator piston may be connected to the inner surface of the cap, where actuation of the piston moves the connected cap.

An actuator may be activated by an electrical signal. In some embodiments, an electrical signal may be sent from an exterior of the housing system to an electronics module inside the housing via a wired connection to activate an actuator, and then from the electronics module to the actuator via another wired connection between the electronics module and the actuator to activate the actuator. In some embodiments, an electrical signal may be sent directly from an exterior of the housing system to an actuator inside the housing via a wired connection to activate the actuator. Additionally, in one or more embodiments, an electrical signal to stop an actuator may be used to limit movement from the actuator. For example, an electrical stop may be used to stop the actuator when the position of the cap is closed against the housing body 102. In some embodiments, the physical limit of the cap contacting the housing body as the cap closes against the housing body may act as a physical stop to slider movement.

In one or more embodiments, the actuators 118 may be hydraulic actuators which utilize hydraulic fluid to power extension and retraction of the first and second caps 108, 110. In other embodiments, the actuators 118 may be electrical actuators or pneumatic actuators. When pneumatic or hydraulic actuators are used, a reservoir for holding compressed gas or hydraulic fluid, respectively, may be held inside the housing body proximate to or integrated with the actuator. Actuators may be electrically powered, for example, via a connection to a power module in the housing system.

The actuators 118, in accordance with one or more embodiments, may supply enough energy to extend and retract the first and second caps 108, 110, and also enough energy to maintain the sealing of the first and second caps 108, 110 to the housing body 102 during transportation of the housing system 100. For example, due to the weight and size of the housing system 100, a crane may be required to transport the housing system 100 between locations, both at the surface and subsea. The actuators 118 may therefore provide enough energy to secure the first and second caps 108, 110 to the housing body 102 for the duration of time in which the housing system 100 is airborne during transportation by a crane.

While actuators 118 are shown in the embodiments in FIGS. 1A-B, in one or more embodiments, caps may be slidably connected to the housing body via multiple sliders and without any actuators. For example, in such embodiments, a cap may be slid between open and closed positions by hand or external mechanical mechanism.

In some embodiments, no threaded components, such as bolts, latches, or fasteners may be required to secure the first cap 108 and the second cap 110 to the housing body 102. For example, in one or more embodiments, as described above, actuators may be used to hold each of the first and second caps 108, 110 against the housing body 102 during transport of the housing system 100. Additionally, when the housing system 100 is used in a subsea environment, the subsea pressure around the housing system 100 may exert a pressure on the caps 108, 110 that holds the caps 108, 110 against the housing body 102.

In some embodiments, one or more seals may be provided between the caps 108, 110 and the housing body 102 to provide a water-tight seal. For example, one or more o-rings, sealing surfaces, or other type of seal may be provided between the inner surface of a cap and an interfacing end surface of an end of the housing body.

Turning now to FIG. 1B, an electronics module 120 may be secured to the inner surface 114 of the first cap 108. In one or more embodiments, sliding the first cap 108 from the housing body 102 using the first set of sliders 112 may allow for easy access to the electronics module 120. A wiring carrier 122 may extend from the electronics module 120, within the housing body 102, to one or more electronics connectors 127 (FIG. 1A) provided on the housing body 102. An electronics connector 127 may be exposed to an exterior of the housing body 102, such that the electronics connector 127 may provide an electrical connection through the wall of the housing body 102, from the exterior of the housing body 102 to the interior of the housing body 102 when the first cap 108 is in a retracted/closed position. In one or more embodiments, the wiring carrier 122 may connect equipment (e.g., subsea equipment) positioned exterior to the housing system 100 with the electronics module 120.

In some embodiments, electronic signals may be sent through the electronics connector 127 to the wiring carrier 122 and electronics module 120 inside the housing body 102 to open or close a cap 108, 110. For example, in some embodiments, when a cap is closed against the housing body, a signal may be sent from outside of the housing body 102 to the electronics module 120 (via an electronics connector 127 and wiring carrier 122) to activate an actuator 118 and open the cap. In some embodiments, when a cap is open, providing access inside the housing body, a signal may be sent from outside of the housing body to activate an actuator inside the housing body and close the cap. A signal sent from outside the housing body to activate an actuator inside the housing may be sent to the electronics module 120, where the electronics module 120 may then activate the actuator (via wired or wireless communication), or the signal may be sent from outside the housing body through a wired connection between the electronics connector 127 to the actuator 118. In embodiments using electric signals to open or close a cap of a housing system, the cap may be automated to open and close at selected times.

Turning now to FIG. 1C, a power module 124 may be secured to the inner surface 126 of the second cap 110. In one or more embodiments, the power module 124 may include a power supply 128 and a dynamic heat sink that is capable of providing a heat sink for the power supply 128 as the power supply is moved with the second cap 110 relative to the housing body 102. For example, in one or more embodiments, a dynamic heat sink includes a dynamic set of fins 130 connected to the power supply 128 and a fixed set of fins 132 connected to the housing body 102. The dynamic set of fins 130 and the fixed set of fins 132 may be configured to slidably interlock with one another, forming a heat sink that may provide thermal conduction from the power source to the housing body. A slidable connection between the dynamic and fixed set of fins 130, 132 may allow for a constant connection between the fins. In one or more embodiments, the power supply 128 may be a battery. A volume of grease may also be used in the power module 124 to improve the heat sink. In addition, in some embodiments, the power module 124 may include a fan to assist with heat dissipation away from the power module 124.

FIGS. 1A-C show an example of a housing system 100 designed for operation in a horizontal orientation, where the caps 108, 110 may be opened and closed while the central axis of the housing body 102 is oriented to be generally parallel with the ground. In such embodiments, approximately equal amounts of force may be applied to the caps (accounting for differences in weight due to the electronics module vs power module connected to each cap) to open and closed the caps. For example, actuators 118 on opposite ends of the housing system may apply approximately equal amounts of force to the cap at their respective end of the housing to open or close the cap.

In some embodiments, as shown in FIG. 1D, a housing system 100 may be designed for operation in a vertical orientation, where the caps 108, 110 may be opened and closed while the central axis of the housing body 102 is oriented to be generally perpendicular to the ground. In such embodiments, different amounts of force may be applied to the caps to oppose gravitational forces acting on the caps as they open and close. For example, to oppose gravitational forces, a greater amount of force may be applied to open the cap at the end of the housing oriented in the uppermost position when compared with the amount of force needed to open the cap at the end of the housing oriented in the lowermost position. Conversely, to oppose gravitational forces, a greater amount of force may be applied to close the cap at the end of the housing oriented in the lowermost position when compared with the amount of force needed to close the cap at the end of the housing oriented in the uppermost position.

In embodiments where a housing system is to be positioned in a vertical orientation, lift connections may be provided at three or more locations around the exterior of the housing system (e.g., at least two lift connections on opposite sides of the exterior of the housing body and at least one lift connection on the exterior of a cap) so that when a crane is connected to and moving the housing, the housing may be kept in the vertical orientation. When the housing is landed by a crane in a vertical orientation, the crane lines may be disconnected from the housing prior to opening the cap in the uppermost position of the housing system.

As shown in FIGS. 1A-D, the electronics module 120 and the power module 124 are secured to the first and second caps 108, 110, respectively, such that each module 120, 124 may slide easily in and out of opposite ends of the housing body 102. Sliding the modules 120, 124 out of the housing body 102 may allow for easy access and serviceability, while sliding the modules 120, 124 into the housing body 102 may allow for protection of the modules 120, 124 from the outside environment.

While two slidably connected caps are provided in the housing system 100 shown in FIGS. 1A-D to provide accessibility to modules 120, 124 at opposite ends of the housing, other modules and configurations may be used in a similar manner to provide accessibility to one or more modules via one or more caps slidably connected to a housing. For example, in some embodiments, a housing system may have a single cap slidably connected to a housing body via a set of sliders, where one or more modules (e.g., a power module and an electronics module) are connected to the inner surface of the cap. In some embodiments, a housing system may have more than two caps slidably connected to a housing body via sliders, where one or more modules are connected to the inner surface of each cap. One or more caps may be slidably connected to a housing body in the same manner as described above, and may or may not use an actuator to open and close the cap.

Modules 120, 124 or other internal components of the housing system may be connected to the inner surface of a cap, within an area of the inner surface between the slider connections to the inner surface. As described above, a slider may include a dynamic rail connected at one end to the inner surface of a cap. The connection between the dynamic rail and the inner surface may be at or proximate the perimeter of the inner surface. Multiple rail connections may be provided at spaced apart locations around the perimeter of the inner surface of the cap. Modules 120, 124 or other internal components of the housing system may be connected to an area of the inner surface inside the rail connections (e.g., at or proximate to a central area of the inner surface).

Figure 2:
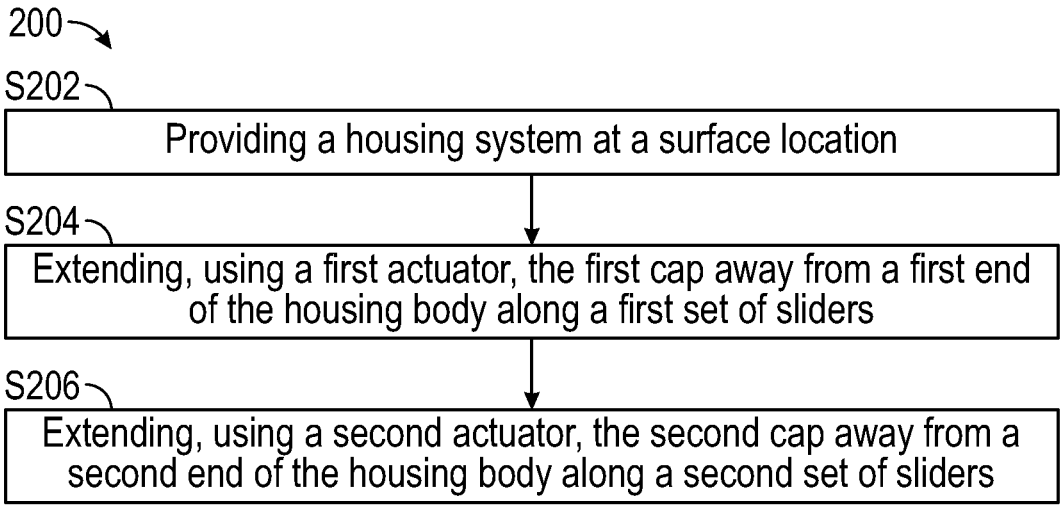
FIG. 2 shows a flowchart of a method in accordance with one or more embodiments.

FIG. 2 depicts a flowchart in accordance with one or more embodiments. More specifically, FIG. 2 depicts a flowchart 200 of a method for operating a housing system according to embodiments of the present disclosure. Further, one or more blocks in FIG. 2 may be performed by one or more components as described in FIGS. 1A-1D. While the various blocks in FIG. 2 are presented and described sequentially, one of ordinary skill in the art will appreciate that some or all of the blocks may be executed in different orders, may be combined, may be omitted, and some or all of the blocks may be executed in parallel. Furthermore, the blocks may be performed actively or passively.

Initially, a housing system 100 may be provided at a surface location, S202. For example, a housing system 100 may be removed from a subsea environment and provided at the surface location for servicing. The housing system 100 may include a housing body 102, a first cap 108, and a second cap 110. In one or more embodiments, removing the housing system 100 from the subsea environment may include using a crane to grip and lift the housing system 100 from a subsea position to a surface facility. A surface facility may refer to a drilling rig or a drilling vessel, for example.

While at the surface location, one or both of the caps 108, 110 may be opened to access modules 120, 124 in the housing system. For example, two actuators 118 secured to an internal surface of the housing body 102 may be operated to open the caps 108, 110. In one or more embodiments, the two actuators 118 may be hydraulically powered. In other embodiments, the two actuators 118 may be electrically powered. In one or more embodiments, operating the two actuators 118 may include sliding the first cap 108 and the second cap 110 between a retracted (e.g., closed) position and an extended (open) position. Using a first of the two actuators 118, the first cap 108 may be extended away from a first end 104 of the housing body 102 along a first set of sliders 112, S204. Further, using a second of the two actuators 118, the second cap 110 may be extended away from a second end 106 of the housing body 102 along a second set of sliders 116, S206.

In one or more embodiments, the actuators may be activated from a position external to the housing. For example, while the housing system is at the surface location, an operator may send a signal (e.g., via a computer system) to activate an actuator to open a cap. While one or more caps are open, providing access to inside the housing system, one or more components in the housing system may be monitored, tested, repaired, inspected, or otherwise accessed. Upon completion of access to components in the housing system, the operator may then send a signal to activate the actuator to close the cap.

In one or more embodiments, after accessing internal components in a housing system 100 and closing the cap(s) to the housing system, a crane or other heavy machine operating equipment may be used to move the housing system. In one or more embodiments, while the housing system is being moved, one or more actuators may be used to hold the cap(s) in a closed position. Advantageously, by using an actuator to hold a cap closed during surface movement, other cap connection mechanisms such as bolts, latches, or threaded connections may not be used.

Additionally, by using sliders to slidably connect a cap to a housing body, bolts or other alignment posts may not be used, as the sliders may act to both slidably connect the cap to the housing body and to keep the cap axially aligned with the housing body.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A housing system, comprising:

a housing body, comprising:

an internal cavity; and an opening at a first end and a second end;

a first cap removably fitted to the first end;

a second cap removably fitted to the second end;

a first set of sliders secured to an internal surface of the housing body and to an inner surface of the first cap;

a second set of sliders secured to the internal surface of the housing body and to an inner surface of the second cap;

a first actuator configured to extend and retract the first set of sliders; and a second actuator configured to extend and retract the second set of sliders.

2. The housing system of claim 1, wherein the first actuator and the second actuator are selected from an electric actuator, a pneumatic actuator, and a hydraulic actuator.

3. The housing system of claim 1, wherein an electronics module is secured to the inner surface of the first cap and a power module is secured to the inner surface of the second cap.

4. The housing system of claim 3, wherein a wiring carrier extends from the electronics module to an electronics connector on an exterior of the housing body.

5. The housing system of claim 3, wherein the power module comprises:

a power supply;

a dynamic set of fins; and a fixed set of fins, wherein the dynamic set of fins and the fixed set of fins are configured to slidably interlock with one another to form a heat sink.

6. The housing system of claim 5, wherein the power module further comprises a fan.

7. The housing system of claim 5, wherein the power module further comprises a volume of grease.

8. The housing system of claim 5, wherein the power supply is a battery.

9. The housing system of claim 1, further comprising at least one seal positioned on at least one of the inner surface of the first cap and an interfacing end surface of the first end.

10. The housing system of claim 1, wherein each of the first cap and the second cap weigh more than 400 pounds.

11. A method, comprising:

providing a housing system at a surface location, wherein the housing system comprises;

a housing body, a first cap slidably connected to a first opening on a first end of the housing body, a first set of sliders secured to an internal surface of the housing body and to an inner surface of the first cap, a second cap slidably connected to a second opening on a second end of the housing body, and a second set of sliders secured to an internal surface of the housing body and to an inner surface of the second cap;

operating at least one actuator secured to an internal surface of the housing body;

extending, using the at least one actuator, the first cap away from the first end of the housing body along the first set of sliders; and extending, using the at least one actuator, the second cap away from the second end of the housing body along the second set of sliders.

12. The method of claim 11, wherein operating the at least one actuator comprises electrically operating the at least one actuator to slide the first cap a retracted position and an extended position.

13. The method of claim 11, wherein operating the at least one actuator comprises hydraulically operating the at least one actuator to slide the first cap between a retracted position and an extended position.

14. The method of claim 11, further comprising moving the housing system from a subsea environment to the surface location using a crane to grip and lift the housing system from a subsea position to a surface facility.

* * * * *